United States Patent [19]

Shaw

[11] 4,247,016

[45] Jan. 27, 1981

[54] LID-STRAW COMBINATION FOR SOFT DRINK CUPS

[76] Inventor: Jack B. Shaw, 2710 Bedford St., Johnstown, Pa. 15904

[21] Appl. No.: 101,020

[22] Filed: Dec. 6, 1979

Related U.S. Application Data

[63] Continuation of Ser. No. 860,726, Dec. 15, 1977, abandoned.

[51] Int. Cl.[3] ..... A47G 19/22; B65D 1/24; B65D 1/36; B65D 57/00

[52] U.S. Cl. ..... 220/90.2; 229/7 S

[58] Field of Search ..... 220/90.2, 90.4, 23, 220/257, 258; 229/7 S

[56] References Cited

U.S. PATENT DOCUMENTS

| | | | |
|---|---|---|---|
| 2,957,614 | 10/1960 | Krajcovic | 220/90.2 X |
| 3,184,134 | 5/1965 | Cohen et al. | 229/7 S |
| 3,240,415 | 3/1966 | Pugh, Sr. | 229/7 S |
| 3,524,566 | 8/1970 | Parks | 220/90.2 X |
| 3,679,093 | 7/1972 | Chang | 229/7 S X |
| 3,874,554 | 4/1975 | Chang | 220/90.2 |
| 4,036,392 | 7/1977 | Martin | 220/90.2 X |
| 4,792,798 | 2/1974 | Chang | 220/90.2 |

FOREIGN PATENT DOCUMENTS

| | | | |
|---|---|---|---|
| 747733 | 12/1966 | Canada | 229/7 S |

*Primary Examiner*—Steven M. Pollard

*Attorney, Agent, or Firm*—Fidelman, Wolffe & Waldron

[57] ABSTRACT

A lid-straw combination with the straw being of pleated form and with most of its length wrapped around the innerperiphery of a drink-container lid, one end of the straw passing through the lid, with removable cover sheets provided over both the protruding portion and the entire upper surface of the lid to maintain a sanitary condition.

7 Claims, 5 Drawing Figures

LID-STRAW COMBINATION FOR SOFT DRINK CUPS

This is a continuation of application Ser. No. 860,726, filed Dec. 15, 1977 now abandoned.

INTRODUCTION

This invention relates to a lid structure containing a stored straw and, more particularly, to a lid-straw combination wherein the straw is maintained in a sanitary condition during storage. Specifically, this invention provides a circular form lid with a straw maintained in a peripheral depression with one end protruding through the lid and with both the protruding end and straw being protected by a sanitary overlay.

PRIOR ART

It has long been recognized as desirable to provide a lid structure for drink cups with an integral straw thereby eliminating the need for separate storage of these items as well as any substantial waste thereof. For example, in U.S. Pat. No. 2,800,265, a lid is provided in which a straw protrudes therethrough of sufficient length to reach the bottom of a container and with an upper portion bent over and retained in a lid recess by a secondary cap structure. A similar design is found in U.S. Pat. No. 3,568,870, while U.S. Pat. No. 1,680,341 suggests either rolling or forming an accordian shape from a standard soda straw and storing same in a cap lid. In this latter teaching, no provision is made for insertion of the straw through the lid. Similar rolling is found in U.S. Pat. No. 3,194,470. Other examples of straws maintained in a container either held by or passing through the lid include U.S. Pat. Nos. 2,724,536; 2,279,396; 2,748,968; 1,962,883; 3,291,331; 2,844,267; 2,432,132 and 2,837,234. In these latter teachings, the straw is generally maintained in the liquid of the container with some form of overlay cap, strip or like device provided which, when removed, provides access to the upper portion of the straw.

These prior art devices wherein the straw, maintained in the liquid contents of the beverage container, tend to deteriorate or may potentially affect the flavor of the container contents; while those maintained totally within the lid require reshaping as well as insertion through the lid, the latter being made more difficult by the weakness of the straw due to flexure or bending during forming.

Obviously where prior art references recognize that the straw should be inserted through the lid, the lid-container combination was created at the bottling or packaging plant as opposed to the point of sale. This last factor is of utmost importance with fast food franchises where carbonated beverages are dispensed in cups for immediate consumption with the current practice being hand application of lids and separate straw provision by customer-activated dispensers. In such case, there is considerable waste as well as the requirement of time and expense for maintenance of straw dispensers. Furthermore, the straw handling and the environment of straw maintenance would indicate that they will be less than sanitary when used by the customer. Of course, individual lids and straws are relatively inexpensive, even with their dispensing and waste problems; and those prior art devices which combine the lid and straw would appear to be quite complex and, therefore, relatively expensive to manufacture.

From the above, it is noted that the discussed prior art structures, although developed with applicant's problem in mind, fail in one respect or another to provide all of the desiderata of a lid-straw combination. This is particularly so in the case of specialty straws due to the expense of raw materials and manufacture.

OBJECTS OF THE INVENTION

Therefore, it is a principal object of the present invention to provide a lid structure with a contained straw in which the straw is not only fully contained within the lid but also penetrates therethrough for ease of beverage access after placement of the lid on a carbonated beverage container.

It is a further object of this invention to provide a lid-straw combination which utilizes a conventional lid design for simplicity of manufacture and known techniques for straw manufacture, whereby the expense of supply can be minimized.

It is still a further object of this invention to combine a straw with a lid in such a manner that sanitary conditions are maintained by simple upper and lower overlays until point of sale with the sales personnel or the customer removing said sanitary overlays along with the possibility that the lower overlay may be left in tact for penetration with the straw by the customer after removal of the upper overlay.

These and other objects of the invention will be apparent when the following specification is considered with the accompanying drawings wherein.

DETAILED DESCRIPTION

Figure 1:
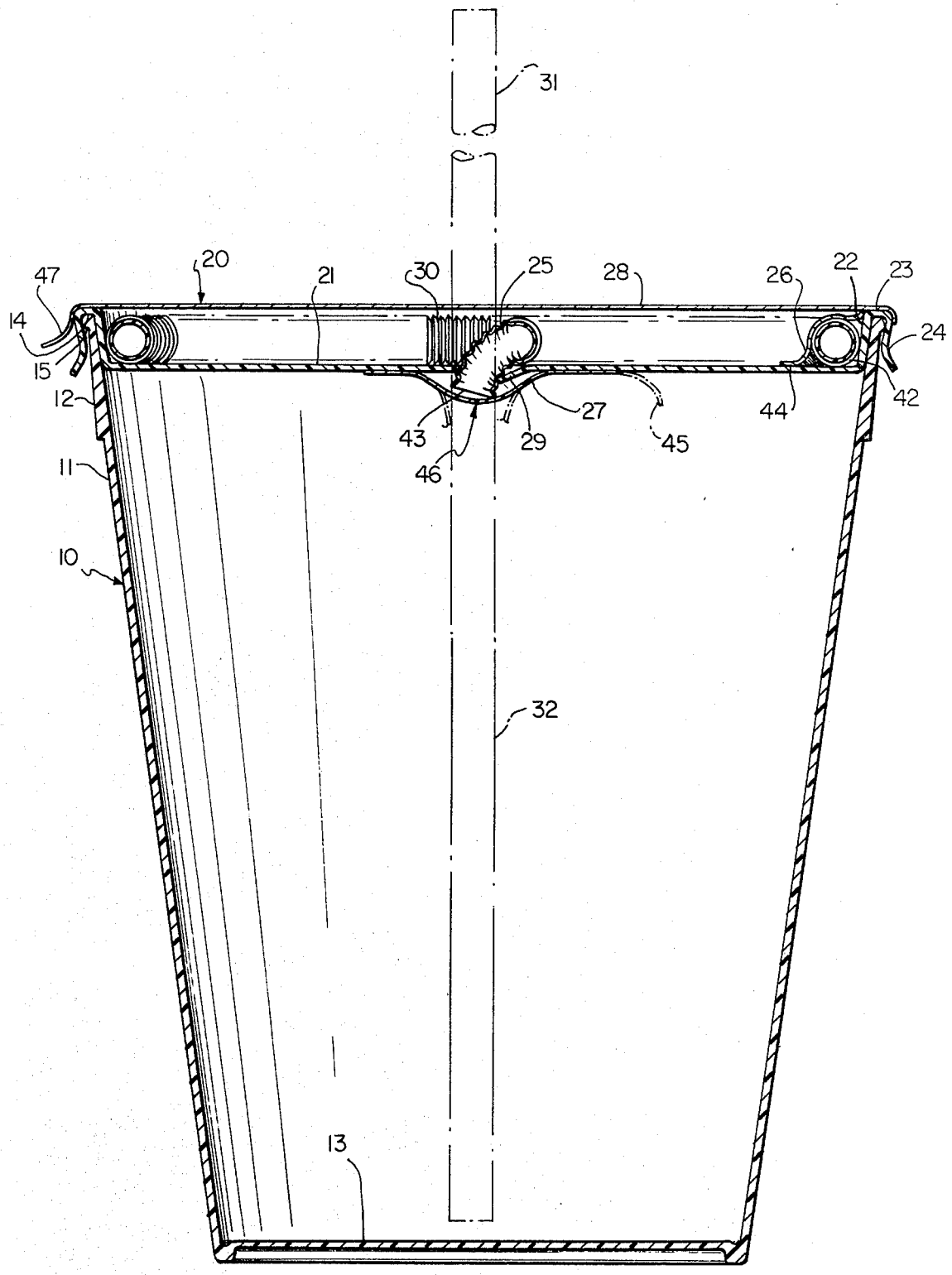
FIG. 1 is a side cross-sectional view showing the straw-lid combination of the instant invention in position on a cup with a phantom line designation of the straw in its use position.

Referring more particularly to the drawings wherein similar reference characters designate like parts throughout the several views and reference particularly to FIG. 1, numeral 10 generally designates a conventional frusto-conical beverage cup formed of paper, polystyrene or other material generally utilized for such purposes. The cup has a continuous side wall 11 terminating at its upper edge in a conventional lid support ridge 12 and at its lower edge being connected to an integral base 13. The support ridge 12 includes a flat upper enlarged section 14, the diameter thereof being greater than that of the next adjacent portion of the ridge 12 to define a detent area 15, the purpose of which will be described infra.

The lid structure, generally designated 20 shown in FIG. 1, is also basically conventional in that it includes a substantially planar circular base 21 of about 2½ to 3" diameter with a cup lip engaging periphery including an inner side wall 22, of substantially the same length as the diameter of a straw, a cup top engaging and sealing section 23 and a free-ended outer side wall 24, said outer side wall being flared outwardly for ease of cup application. Such application provides that the outer side wall 24 is held by the detent area 15 of the cup.

Figure 2:
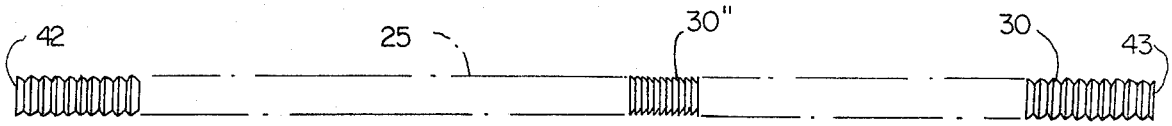
FIG. 2 is a side view of the straw showing both compressed and extended pleat designs before placement in the lid rim.

Referring to FIG. 2, a straw 25 is formed of plastic, reinforced paper or the like, said straw being of constant diameter and having along substantially its entire length a pleat configuration shown extended 30 and unextended 30''. This is identical to that utilized currently in hospital straws for liquids to allow patients to drink without rising from their beds. Such are manufactured, for example, by the Flexible Plastic Straw Corporation. However, in the case of currently manufactured straws, the pleated configuration is only at one area of the straw generally covering only about one-tenth or less of the total straw length rather than the full length thereof as provided herein.

Figure 3:
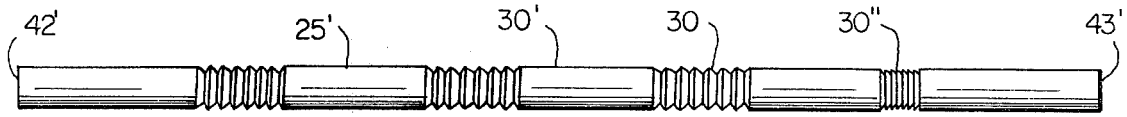
FIG. 3 is an alternative embodiment of the straw of FIG. 2.

This continuously-pleated, preferably plastic, straw may terminate in a short non-pleated section on either or both ends, as shown in FIG. 3; and the pleated patterns 30 may be discontinuous to provide straight sections 30' in the alternative embodiment straw 25' of FIG. 3.

Figure 4:
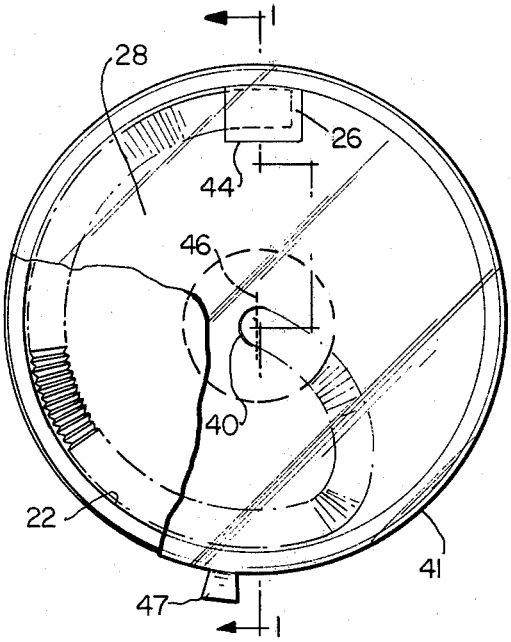
FIG. 4 is a top plan view of the straw of FIG. 2 when mounted in the lid of FIG. 1.

The straw is combined with the lid 20 of FIG. 1 by providing the lid with a central aperture 40 which may be in the form of a slit or hole. Also the inner side wall 22 is of substantially the same height as the diameter of the straw 25. One end 42 of the straw 30 extends a very short distance through said aperture 40 and, as shown in FIG. 4, from said aperature in an arcuate portion 41 to the inner side wall 22, where it is confined by said side wall until the other end 43 of said straw is reached. This end 43 is preferably held in place by a narrow adhesive strip 26 which extends from the junction of side wall 22 and top 23 of said lid 20 to the base 21 of said lid at an area 44 toward the middle of said lid. Alternatively, the straw will tend to bias against the inner side wall so no additional strip is necessary.

The actual dimensions of the straw may vary, although desirably should be about eight inches long when the pleats are extended. Since the stretching of a pleated straw generally leads to at least a doubling of its length, the straw, before wrapping around the inner periphery of the lid, should be on the order of four inches. Obviously, the wrapping (bending the straw will extend the pleats on one side more than the other) provides an outer peripheral length greater than the inside peripheral length. The diameters of conventional straws are in the order of 0.25 inches; although a lesser diameter may be utilized when the lid inner wall height is less than 0.25 inches.

An underlay sheet 27 of plastic such as Mylar or Saran (polyvinylidene chloride) is provided over that portion of the straw which extends through the aperture 40 in said lid 20. This plastic may be heat sealed or otherwise (electrostatic attraction) held to the bottom of said lid and may be provided with a weakened slit 46 or a pull tab 45 to facilitate respectively either penetration by the straw 25 when used or removal of the sheet 27 before use. This sheet, as shown in phantom in FIG. 4, is preferably circular in shape although other shapes may be used provided full coverage of the protruding straw section (preferably about ⅛") is accomplished.

An overlay sheet 28 is also provided over the lid straw combination, this sheet also being preferably a plastic film of polyester resin, polyvinylidene chloride or cellophane and sealed to the upper rim 23 of the lid by heat, electrostatic attraction or adhesive. A pull strip 47 may be provided in the edge to facilitate removal. This sheet cooperates with the strip 26 to hold the straw in position.

Figure 5:
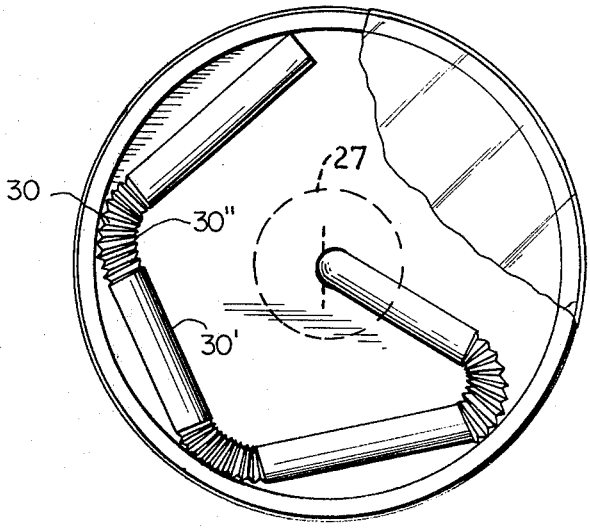
FIG. 5 is a top plan view of the alternative embodiment straw of FIG. 3 when mounted in the lid of FIG. 1.

FIG. 5 shows the straw 25' of FIG. 3 maintained in the lid 20, it being noted that any structure not shown or described would be identical in either of the two embodiments shown.

To utilize this device, the container is filled with a carbonated beverage or the like and the lid placed thereon as shown in FIG. 1. As long as neither sheet 21 or 27 has been removed or penetrated, the straw's sanitary condition is maintained. To use the straw, the cover sheet 21 is pulled by the tab 47 until it separates totally from the lip 23 of the lid 20. This exposes the straw holding tape 26 which is likewise removed by peeling. The straw can then be lifted by its end 42 to be substantially perpendicular to the lid and, thereafter, pushed through the weakened slit 46 in said sheet 27 to the bottom of the container as shown in phantom in FIG. 1, said straw having by said insertion a section 31 which will still be above the lid and a portion 32 in the container extending into the beverage.

The pleated portions, whether continuous as in FIG. 2 or discontinuous as in FIG. 3, permit the maintenance in the lid periphery as well as the straight line configuration during normal use.

As an alternative in use, the person dispensing the beverage may remove the lower overlay sheet 27 by pulling the tab 45 with the customer only removing the upper overlay sheet 28 and subsequent pushing of the tube through the slit or aperture 40.

While I have shown the preferred embodiments of my straw-lid combination, it is apparent that changes and improvements may be made therein. For example, the lip arrangements may be varied to fit different cup forms while the central shape of the lid could be depressed to provide a drip catch. Other changes could be made without departing from the scope or spirit of the appendant claims:

I claim:

1. A sanitary lid-straw combination comprising:

a substantially circular lid having a raised peripheral lip formed of an inner wall, a top surface and outer side wall, said lip being positionable over the upper edge of a drink cup;

a straw having pleats along a substantial portion of its length, said straw being positioned for a major proportion of its length around said inner wall of said lid, one end of said straw being maintained at said inner wall of said lid, the other end of said straw slidably passing through a central aperture in said lid and terminating adjacent thereto;

a first protective cover disposed over the entire top of said lid and attached to said peripheral lip, and a second protective cover disposed over the central portion of the lid bottom, said second cover forming a seal between the straw end and the contents of a drink cup.

2. The lid-straw combination of claim 1 wherein said straw is provided with said pleats substantially continuously between said ends.

3. The lid-straw combination of claim 1 wherein said straw has a pattern of pleated and plain areas throughout its length.

4. The lid-straw combination of claim 1 wherein said second cover sheet is provided with a weakened portion which will allow penetration of said straw when said combination is placed on a beverage container.

5. The lid-straw combination of claim 1 wherein at least one of said cover sheets is provided with a pull tab to facilitate removal from said lid.

6. The lid-straw combination of claim 1 wherein a removable strip holds said one end of said straw against said inner side wall of said lip.

7. The lid-straw combination of claim 1 wherein the height of the inner wall of said lid lip is the same as the diameter of the straw.

* * * * *